US006769903B2

(12) United States Patent
Eroglu et al.

(10) Patent No.: US 6,769,903 B2
(45) Date of Patent: Aug. 3, 2004

(54) METHOD FOR OPERATING A BURNER AND BURNER WITH STEPPED PREMIX GAS INJECTION

(75) Inventors: Adnan Eroglu, Untersiggenthal (CH); Jaan Hellat, Baden-Ruetihof (CH); Peter Stuber, Zurich (CH)

(73) Assignee: Alstom Technology LTD, Baden (CH)

( * ) Notice: Subject to any disclaimer, the term of this patent is extended or adjusted under 35 U.S.C. 154(b) by 0 days.

(21) Appl. No.: 10/311,248

(22) PCT Filed: Jun. 13, 2001

(86) PCT No.: PCT/IB01/01129

§ 371 (c)(1),
(2), (4) Date: Apr. 11, 2003

(87) PCT Pub. No.: WO01/96785

PCT Pub. Date: Dec. 20, 2001

(65) Prior Publication Data

US 2003/0152880 A1 Aug. 14, 2003

(30) Foreign Application Priority Data

Jun. 15, 2000 (DE) ..... 100 29 607

(51) Int. Cl.[7] ..... F23C 5/00; F23D 14/46

(52) U.S. Cl. ..... 431/8; 431/12; 431/350; 431/354; 60/737

(58) Field of Search ..... 431/8, 12, 181, 431/182, 187, 188, 166, 167, 350–354, 175, 176, 10, 11, 18, 9, 278; 60/39.23, 737, 752, 748, 39, 464, 743

(56) References Cited

U.S. PATENT DOCUMENTS 5,127,821 A * 7/1992 Keller ..... 431/10
5,461,865 A 10/1995 Snyder et al.
5,482,457 A 1/1996 Aigner et al.
6,027,331 A * 2/2000 Dobbeling et al. ..... 431/182

FOREIGN PATENT DOCUMENTS

| | | | |
|---|---|---|---|
| DE | 413283 | 5/1925 | |
| DE | 4304213 A1 | 8/1994 | ..... F23D/17/00 |
| EP | 0433790 A1 | 6/1991 | ..... F23D/17/00 |
| EP | 0625673 A2 | 4/1994 | ..... F23C/7/00 |
| EP | 0760450 A2 | 3/1997 | ..... F23C/7/00 |
| EP | 0777081 A2 | 6/1997 | ..... F23C/7/00 |
| EP | 0908671 A1 | 4/1999 | ..... F23D/17/00 |
| EP | 0918191 A1 | 5/1999 | ..... F23D/17/00 |
| WO | WO93/17279 | 9/1993 | ..... F23D/14/02 |
| WO | WO95/16881 | 6/1995 | ..... F23D/11/10 |

OTHER PUBLICATIONS

International Search Report for PCT Application No. PCT/IB01/01129, issued Nov. 5, 2001.
Search Report for German Application No. 10029607.6, issued Apr. 6, 2001.

* cited by examiner

*Primary Examiner*—James C. Yeung
(74) *Attorney, Agent, or Firm*—Adam J. Cermak

(57) ABSTRACT

The present invention relates to a method of operating a burner, which comprises at least one first fuel supply conduit (5) with a first group of fuel outlet openings (6), essentially arranged in the direction of a burner longitudinal axis (3), for a first premix fuel quantity and one or a plurality of second fuel supply conduits (7) with a second group of fuel outlet openings (8), essentially arranged in the direction of the burner longitudinal axis (3), for a second premix fuel quantity, it being possible to admit fuel to the second fuel supply conduits (7) independently of the first fuel supply conduit (5). In the method, both fuel supply conduits (5, 7) are operated with the same fuel. By means of the present method of operating a burner, optimum mixing conditions can be set even in the case of different loads, gas qualities or gas preheat temperatures.

27 Claims, 11 Drawing Sheets

Fig. 2
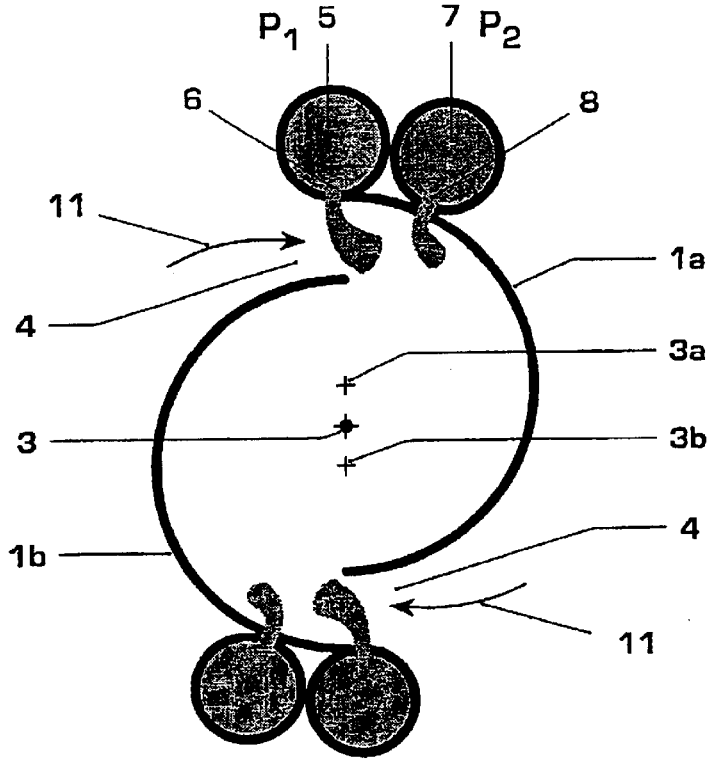
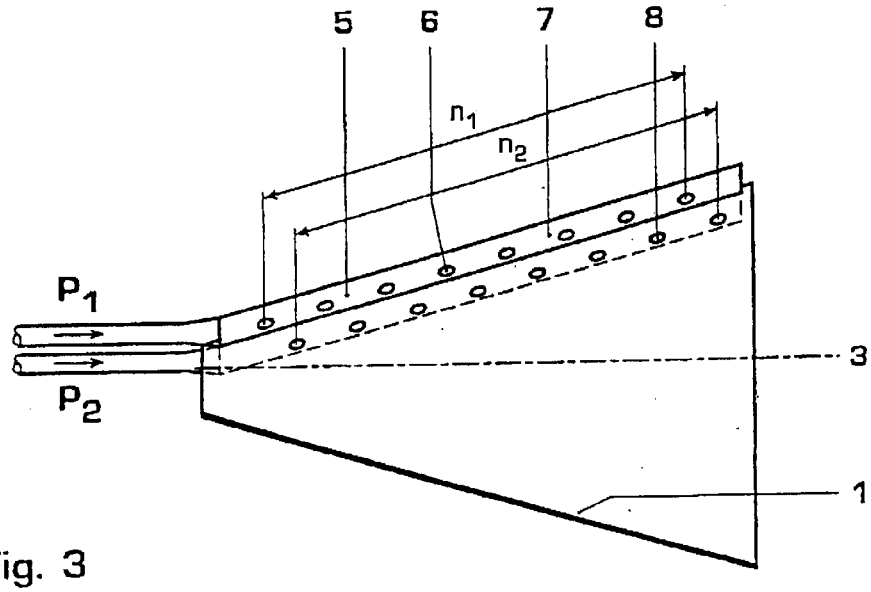
Fig. 3

METHOD FOR OPERATING A BURNER AND BURNER WITH STEPPED PREMIX GAS INJECTION

BACKGROUND OF THE INVENTION

The present invention relates to a method of operating a burner, which has at least one first fuel supply conduit with a first group of fuel outlet openings, essentially arranged in the direction of a burner longitudinal axis, for the introduction of a first premix fuel quantity into a swirl space and one or a plurality of second fuel supply conduits with a second group of fuel outlet openings essentially arranged in the direction of the burner longitudinal axis, it being possible to admit fuel to the second fuel supply conduits independently of the first fuel supply conduit. The invention also relates to a burner which can be advantageously operated by means of the method. The combustion spaces of gas turbines are a preferred field of employment for such burners; in addition such burners are, for example, also employed in atmospheric boiler firing systems.

RELATED ART

A conical burner consisting of a plurality of shells, a so-called double-cone burner, is known from EP 0 321 809. A swirl flow in the interior space of the cone enclosed by the conical partial shells is generated by the conical swirl generator composed of a plurality of shells. Because of a cross-sectional step at a combustion-space end of the burner, the swirl flow becomes unstable and merges into an annular swirl flow with reverse flow at the core. This reverse flow permits stabilization of a flame front at the burner outlet. The shells of the swirl generator are combined in such a way that tangential air inlet slots for combustion air are formed along the burner longitudinal axis. Supply conduits for a gaseous premix fuel are provided at the inlet flow edge of the conical shells formed by this means. These supply conduits have outlet openings, distributed in the direction of the burner longitudinal axis, for the premix gas. The gas is injected transverse to the air inlet gap through the outlet openings or holes. In association with the swirl, generated in the swirl space, of the flow of combustion air and fuel gas flow, this injection leads to good mixing of the fuel gas or premix gas with the combustion air. In such premix burners, good mixing is the precondition for low $NO_x$ values during the combustion process.

For further improvement to such a burner, a burner for a heat generator is known from EP 0 780 629, which burner has an additional mixing section, which abuts the swirl generator, for further mixing of fuel and combustion air. This mixing section can, for example, be embodied as a downstream tube, into which the flow emerging from the swirl generator is transferred without appreciable flow losses. By means of this additional mixing section, the degree of mixing can be further increased and, therefore, the pollutant emissions reduced.

WO 93/17279 shows a further known premix burner, in which a cylindrical swirl generator with an additional conical inner body is employed. In this burner, the premix gas is likewise injected into the swirl space by means of supply conduits with corresponding outlet openings, which are arranged along the axially extending air inlet slots. In the conical inner body, this burner has, in addition, a central supply conduit for fuel gas, which can be injected for pilot operation into the swirl space near the outlet opening of the burner. This additional pilot stage is used for starting the burner. The supply of the pilot gas in the outlet region of the burner leads, however, to increased $NO_x$ emissions because it is only inadequate mixing with the combustion air which can take place in this region.

EP 0918191 A1 shows a burner, of the generic type, for operating a heat generator which, parallel to a first supply conduit for fuel, also has a second supply conduit for another type of fuel, which supply conduit is matched to the other type of fuel. The two supply conduits can be initiated independently of one another. By means of this design, the burner can be operated, without modification, on different types of fuel.

In all the burners presented, the injection of the premix gas in the air inlet gap takes place by means of supply conduits with outlet openings essentially arranged in the direction of the burner longitudinal axis. In consequence, the characteristics of the injection are predetermined with respect to penetration depth, mixing of the gas jets and the fuel distribution along the air inlet slots or the burner longitudinal axis. The arrangement of the outlet openings has therefore already determined the quality of mixing of the gas and the combustion air and the fuel distribution at the burner outlet. These parameters are, in turn, decisive for the $NO_x$ emissions, for the flame-out and flash-back limits and for the stability of the burner with respect to combustion pulsations.

In the case of different loads, gas qualities or gas preheat temperatures, however, different upstream gas pressures occur at the outlet openings and these, in turn, lead to different premixing conditions and mixture qualities at the fuel outlet. The different premixing conditions then result in different emission values and stability conditions, which depend on the load, the gas quality and the gas preheating. The known burners can therefore only be operated optimally for quite specific value ranges of these parameters.

A problematic feature in the operation of premix burners, particularly in gas turbines, is the part-load range because, in this range, the combustion air is mixed with only comparatively small fuel quantities. In the case of the complete mixing of the fuel with the whole of the air, however, a mixture occurs which is no longer capable of being ignited, particularly in the lower part-load range, or is only capable of forming a very unstable flame. This can lead to damaging combustion pulsations or to the flame becoming completely extinguished.

In order to match the known burners to certain emission values or to a certain stability window in the case of different loads, environmental conditions, gas qualities and preheat temperatures, the possibility currently exists of, on the one hand, staging the premix gas supply to individual burner groups in cases where multiple burner arrangements are employed. This, however, is only possible in the case of multi-row burner arrangements. In the case of single-row annular combustion chambers, this technology has the disadvantage that a temperature profile, which is non-uniform in the peripheral direction, appears at the combustion chamber outlet.

Another possibility, as already sketched above, is to equip burners with a so-called pilot fuel supply. The burners are then operated as diffusion burners at very high excess air numbers. This results, on the one hand, in superior flame stability but, on the other, in high emission values and further technical disadvantages in operation.

The object of the present invention consists in providing a burner operating method and a burner, by means of which the burner can, as far as possible, be stably operated in premix operation at approximately constant $NO_x$ emission values, even in the case of changes to the load, the gas quality or the gas preheat temperature.

SUMMARY OF THE INVENTION

The object is achieved by means of the method according to claims 1 and 7 and the burner according to claim 8. Advantageous designs and developments of the burner and the method are the subject matter of the subclaims.

In the present method, a burner with swirl body and swirl space is employed which has at least one first fuel supply conduit, with a first group of fuel outlet openings essentially arranged in the direction of a burner longitudinal axis, for the introduction of a first premix fuel quantity into the swirl space and one or a plurality of second fuel supply conduits with a second group of fuel outlet openings essentially arranged in the direction of the burner longitudinal axis, it being possible to admit fuel to the second fuel supply conduits independently of the first fuel supply conduit. In order to operate the burner, the supply of the fuel via the first fuel supply conduits is controlled, in an open-chain or closed-loop manner, separately from the supply of the fuel via the second fuel supply conduits, the same fuel being supplied to the first and second fuel supply conduits. By controlling the mass flow ratio between the first fuel quantity supplied via the first fuel supply conduits and a fuel quantity supplied via the second fuel supply conduits during the operation of the burner, the burner can be stably operated with approximately constant $NO_x$ emission values even in the case of changes to the load, the gas quality or the gas preheat temperature.

In the preferred embodiment, the fuel is then employed as a premix fuel and is divided at variable mass flow ratio between the first and second supply conduits. The feed of premix fuel differs from the feed of pilot fuel, i.e. of fuel for realizing a pilot stage, in that premix fuel is introduced into the swirl space with a higher inertia, preferably transverse to the flow of the combustion air. When, on the other hand, the fuel is introduced as pilot fuel, the burner is operated in a diffusion mode.

The fuel is preferably introduced into the burner in such a way that it is distributed between the first and second fuel supply conduits as a function of the load.

In a further preferred mode of operation of the burner, in a first operating condition, the whole of the fuel quantity is essentially supplied via the first fuel supply conduit or conduits and is introduced into the combustion airflow via the first group of fuel outlet openings and, in a further operating condition, at least a part of the total fuel quantity is introduced into the combustion airflow via at least one of the second fuel supply conduits with the second group of fuel outlet openings.

If the burner is operated in a heat generator, the total fuel can, in a partial load condition of the heat generator, be supplied via the first fuel conduits and, in full-load operation of the heat generator, the fuel can be divided between the first fuel supply conduits and one or a plurality of second fuel supply conduits.

In addition to the above-mentioned load-dependent distribution of the fuel between the first and second fuel supply conduits, the distribution can also be controlled according to other operating parameters. As an example, the fuel can also be distributed between the first and second fuel supply conduits as a function of measured combustion chamber pulsations of a gas turbine, of pollutant emissions, of measured material temperatures, of the flame position recorded by a flame position sensor or of other measured or operating parameters.

The one or a plurality of second fuel supply conduits, by means of which the quantity—and therefore also the upstream fuel pressure—of premix fuel which is injected into the swirl space via the second group of fuel outlet openings can be set independently of the quantity of premix fuel which flows via the first fuel supply conduits, make possible a simple matching of the mixture distribution and the mixture quality to different boundary conditions. In addition, this design also makes it possible to achieve compensation for different Wobbe indices by, for example, the first fuel supply conduits supporting a certain power or a certain volume flow and the rest of the power or the volume flow being operated by means of the second fuel supply conduits. The axial and radial fuel distribution in the burner can be favorably influenced by appropriate arrangement of the second fuel supply conduits, with the corresponding second group of fuel outlet openings, relative to the first fuel supply conduits, with the first group of fuel outlet openings. It is therefore possible to achieve a specified enrichment of the mixture with fuel in certain regions of the burner outlet, during part-load operation, in order to improve the flame stability. At high burner load, the fuel can then be uniformly distributed, which results in low emissions.

By means of a design, in which premix fuel can also be admitted—and is admitted—to a plurality of second fuel supply conduits independently of one another, an even more finely staged matching of the mixture distribution and the mixture quality to different boundary conditions can be undertaken.

In addition, the invention also includes designs such as those in which—in addition to first and second fuel supply conduits—third, fourth etc fuel supply conduits are also present and can have fuel admitted to them independently.

The present burner consists of a swirl generator for a combustion airflow, a swirl space and means for introducing fuel into the combustion airflow, the swirl generator having combustion air inlet openings for the combustion airflow entering tangentially into the swirl space, which comprise means for introducing fuel into the combustion airflow of one or a plurality of first fuel supply conduits with a first group of fuel outlet openings, essentially arranged in the direction of a burner longitudinal axis, for a first premix fuel quantity and the burner has one or a plurality of second fuel supply conduits with a second group of fuel outlet openings essentially arranged in the direction of the burner longitudinal axis, for a second fuel quantity, preferably a premix fuel quantity, it being possible to admit fuel to these second fuel supply conduits independently of the first fuel supply conduit or conduits. In the preferred variant described, the burner is characterized by an inner body being arranged in the swirl space, the fuel outlet openings of at least one second fuel supply conduit being arranged on the inner body, essentially distributed in the direction of the burner longitudinal axis. In a preferred embodiment, the inner body is a fuel lance, which is arranged in the swirl space on the burner longitudinal axis.

One or a plurality of the first groups of fuel outlet openings are preferably arranged in the region of at least one of the combustion air inlet openings.

In the present application, an arrangement essentially in the direction of the burner longitudinal axis is to be understood as an arrangement on longitudinal axes which extend parallel to or at an angle of <45° to the burner longitudinal axis.

In a possible embodiment of the present burner, some of the second fuel supply conduits are also arranged immediately adjacent to the first fuel supply conduits, preferably parallel to the latter. In this arrangement, at least one second fuel supply conduit should be provided adjacent to each first fuel supply conduit.

It is, however, obvious per se that the second fuel supply conduits can also be provided in symmetrical arrangement on the swirl generator, independently of the first fuel supply conduits. In this case, the geometry of the swirl generator is unimportant. As an example, conical swirl generators, such as are known from the publications, mentioned at the beginning, of the prior art, for example with two, four or more air inlet slots, can be employed. Other geometries, such as cylindrical swirl generators or cylindrical swirl generators with conical or cylindrical inner bodies can also be employed.

In one embodiment of the burner, some of the second fuel supply conduits are arranged on the outer shell of the swirl body and in particular, in this arrangement, on the air inlet slots along the latter. In the present burner, the essential feature is that the second fuel supply conduits have a plurality of fuel outlet openings, which are essentially distributed in the direction of the burner longitudinal axis, in order to permit the achievement of adequate premixing. The outlet openings arc usually located on longitudinal axes extending parallel to the burner longitudinal axis or on longitudinal axis at an angle to the burner longitudinal axis predetermined by a conical shape of the swirl generator or inner body.

Depending on the possibilities desired for influencing the premixing, the second fuel outlet openings of the second fuel supply conduits can have different distances between them or flow cross sections, as compared with the first fuel outlet openings. Particularly in the case of an arrangement in which at least one second fuel supply conduit is also provided immediately adjacent to a first fuel supply conduit, the respective fuel outlet openings can also have the same distances between them, but be arranged offset relative to one another. This leads to a uniform injection of the premix fuel into the swirl space. In addition, the first fuel outlet openings can, for example, be arranged over the whole of the axial extent of the combustion air inlet openings, but the second fuel outlet openings being only arranged within a certain partial axial region. In a similar manner, it is also possible to provide the first fuel outlet openings in a first axial partial region only and the second fuel outlet openings only in a second axial partial region abutting the first partial region—or vice versa. Different possibilities for influencing the operation of the burner on the basis of these different design possibilities, to whose combination no practical limits are set, can be taken from the exemplary embodiments.

For mutually independent admission of the premix fuel to the first and the second fuel supply conduits, the latter are equipped with different connections. Additional means are preferably provided for the mutually independent closed-loop or open-chain control of the premix fuel supply to the first and the second fuel supply conduits. The different supply can, for example, be controlled by an suitable control valve.

BRIEF DESCRIPTION OF THE DRAWING FIGURES

The burner according to the invention and burner, by means of which the method according to the invention can be carried out, are again explained in more detail below using exemplary embodiments in association with the drawings, without limitation to the general concept of the invention. In the drawings:

FIG. 2 shows an example of the gas outlet from the outlet openings in a possible mode of operation of the burner represented in FIG. 1;

FIG. 3 shows, diagrammatically, an example of the arrangement of the fuel supply conduits and the burner outlet openings of a burner which can be operated with the method according to the invention;

DETAILED DESCRIPTION OF EXEMPLARY EMBODIMENTS OF THE INVENTION

The following figures show the burners in strongly diagrammatic embodiment, so that only the features essential for the respective explanation are emphasized in each case. The specialist is familiar with the further arrangement of the burners represented, inter alia from the documents cited as the prior art, which represent an integrated constituent of the present description. In addition, reference is made in some cases to the injection of gaseous fuel in the exemplary embodiments. It is, however, obvious per se that liquid fuels can also be introduced into the combustion air flow via the fuel outlet openings. The fuel is, in addition, referred to as premix fuel; it is obvious per se that a part of the total fuel quantity can also be introduced in certain load ranges as pilot fuel in order to further increase the flame stability. No supply conduits for pilot fuel are shown in any of the figures because they are not essential to the invention; given knowledge of the prior art, the specialist will, however, readily know how to implement these in the burners represented as examples, should be consider this to be necessary.

A first example of a burner which can be operated with the method according to the invention is represented in FIG. 1.

Figure 1A:
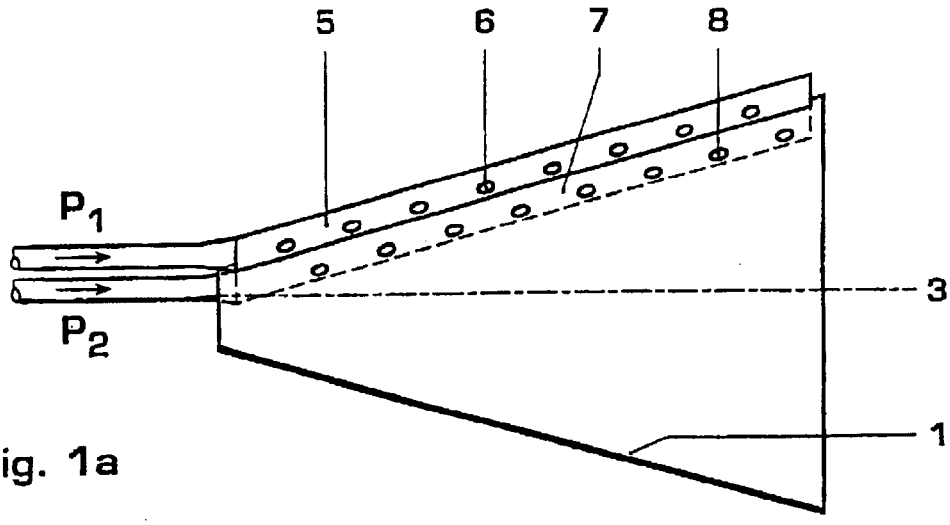
FIG. 1 shows, diagrammatically, an exemplary embodiment of a burner which can be operated with the method according to the invention, in longitudinal and transverse cross section.

FIG. 1*a* shows an arrangement of the first fuel supply conduit 5 and the second fuel supply conduit 7 in the case of a burner with conical swirl body 1. In the outer shell of this swirl body 1, a second supply conduit 7 for a second premix fuel quantity P2 is arranged adjacent to the first supply conduit 5 for a first premix fuel quantity P1 in the outer shell of this swirl body 1 on the inlet flow edges of the air inlet slots, as they are known to the specialist from the prior art. Premix fuel can be admitted to these two supply conduits independently of one another, i.e. the mass flow of the second premix fuel P2, which flows through the second supply conduit 7, for example, can be set independently of the mass flow of the first premix fuel P1 through the first supply conduit 5. This is indicated by the arrows through the different supply conduits. It is obvious per se that a plurality of these supply pairs 5, 7 are preferentially arranged symmetrically around the burner longitudinal axis. The fuel supply to the two supply ducts can be set, independently of one another, by means of control valves which are not explicitly shown here. The arrangement of the control valves is not represented in the example but the specialist is readily familiar with it.

Figure 1B:
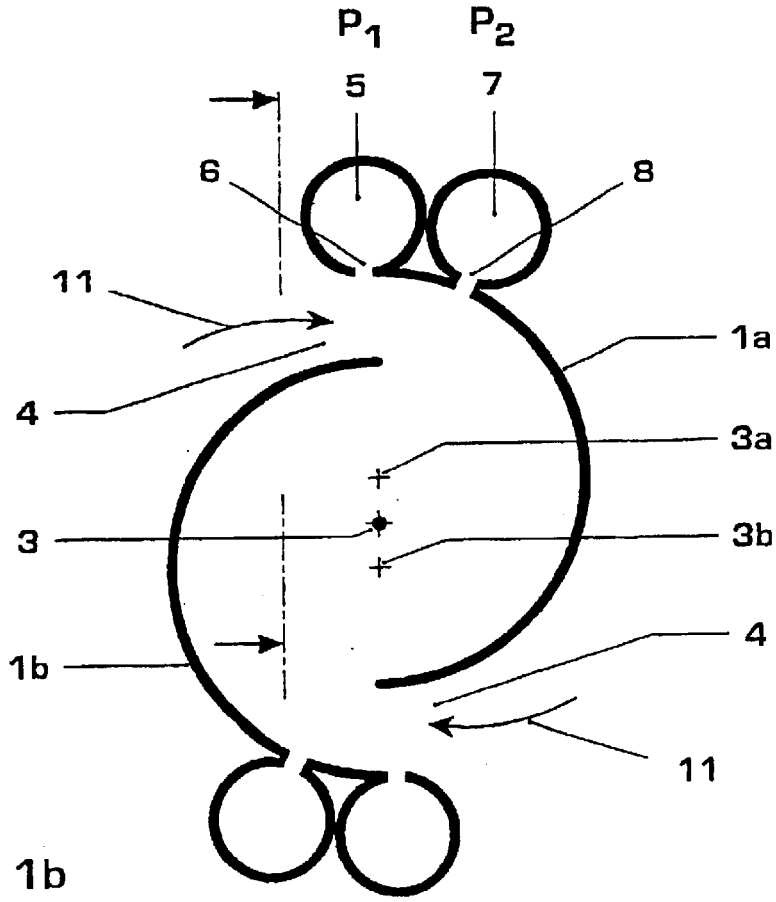

The burner is represented in the vertical section through the burner longitudinal axis 3 in FIG. 1*b*. In this illustration, the two shells 1*a*, 1*b* of the swirl body can be recognized. These are arranged with axes of symmetry 3*a*, 3*b* offset to the actual burner longitudinal axis 3 in such a way that air inlet slots 4 for the combustion air 11 are configured between them. The first supply duct 5 with the corresponding outlet openings 6 for the premix fuel may be recognized, in a manner known from the prior art, on such an air inlet slot 4. The second supply duct 7 with the corresponding second outlet openings 8 is arranged immediately adjacent to this first supply duct 5. The outlet openings 6, 8 of the two supply ducts point toward the inflowing combustion air flow.

Due to the staging of the premix fuel quantities by means of supply ducts which can have mutually separate admission, the penetration depth of the premix fuel quantities P1, P2 into the combustion air flow can be set to be large over one supply duct and to be small over the other supply duct. This is represented diagrammatically in FIG. 2, which figure represents the arrangement of FIG. 1 in a possible mode of operation. In this case, the fuel quantity in the first supply duct 5 is set to be higher than it is in the second supply duct 7, so that the pressure, and therefore the outlet velocity, of the fuel at the outlet openings 6 is increased as compared with the outlet openings 8. The first premix fuel P1 from the first supply duct 5 therefore penetrates deeper into the combustion air flow than the premix fuel P2 from the second supply duct 7, as is indicated in the figure. The same effect can also be achieved by different opening diameters or flow cross sections of the respective outlet openings, it then being possible to select the fuel quantities flowing through the two ducts to be identical for different penetration depths.

With this arrangement, therefore, the mixture distribution and the mixing quality in the burner can be set in a specified manner.

FIG. 3 shows a variant of the arrangement of the supply ducts and the outlet openings. In this example also, the conical swirl body 1 is represented with respectively first and second supply ducts 5, 7, in strongly simplified form for purposes of illustration. In this case also, the two supply ducts are located in parallel adjacent to one another on the tangential air inlet slot—not represented. In this arrangement, the two supply ducts have the same number of holes n1 and n2. The holes are uniformly distributed along the burner longitudinal axis 3, the axial arrangement of the holes 8 of the second supply duct 7 being set on gaps relative to the axial arrangement of the holes 6 of the first premix fuel supply conduit. The number of holes n1 and n2 can also, of course, be different from one another.

The possibility of arranging or distributing the holes of the supply ducts differently or to provide them with different diameters permits the axial and radial fuel distribution in the burner and/or at the burner outlet to be influenced in a specific manner.

As an example, the axial and radial fuel distribution can be influenced by a non-uniform arrangement of the holes 8 along the second supply duct 7 or the burner longitudinal axis 3, as is represented in the following figures.

Figure 4:
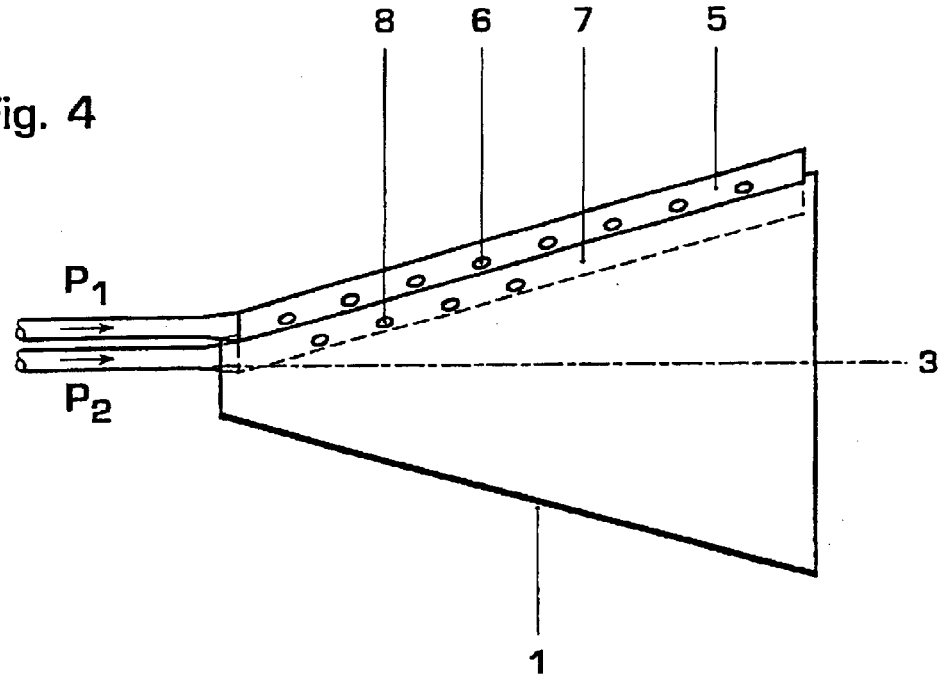
FIGS. 4 to 7 show examples of the arrangement of the fuel supply conduits and fuel outlet openings of a burner which can be operated with the method according to the invention.

In these, FIG. 4 shows an arrangement in which the holes 6 of the first supply duct 5 are distributed in the usual manner at uniform distances apart in the direction of the burner longitudinal axis 3. In this example, the holes 8 of the second supply duct 7 are only distributed in the direction of the burner longitudinal axis 3 over the first half of the swirl space. By means of this hole arrangement, an enrichment of the fuel mixture in the burner center can be achieved by switching on this second stage—the premix fuel supply via the second supply conduit 7.

Figure 5:
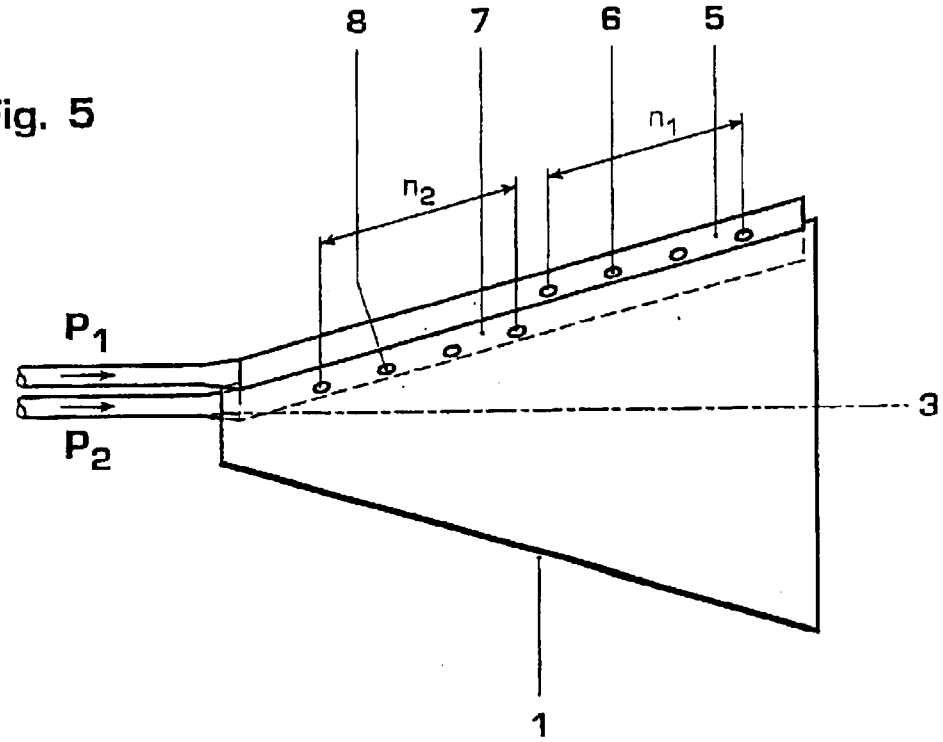

FIG. 5 shows a similar arrangement in which the holes 8 of the second supply duct are likewise arranged in the direction of the burner longitudinal axis 3 in the first region of the swirl space, as in the case of FIG. 4. In this example, however, the holes 6 of the first supply duct 5 are not distributed over the complete length of the swirl space in the direction of the burner longitudinal axis 3 but only in the second part, which is directed towards the burner outlet. The number n1 or n2 of the respective holes can be selected to suit the requirements. These can be the same or can also be different.

Figure 6:
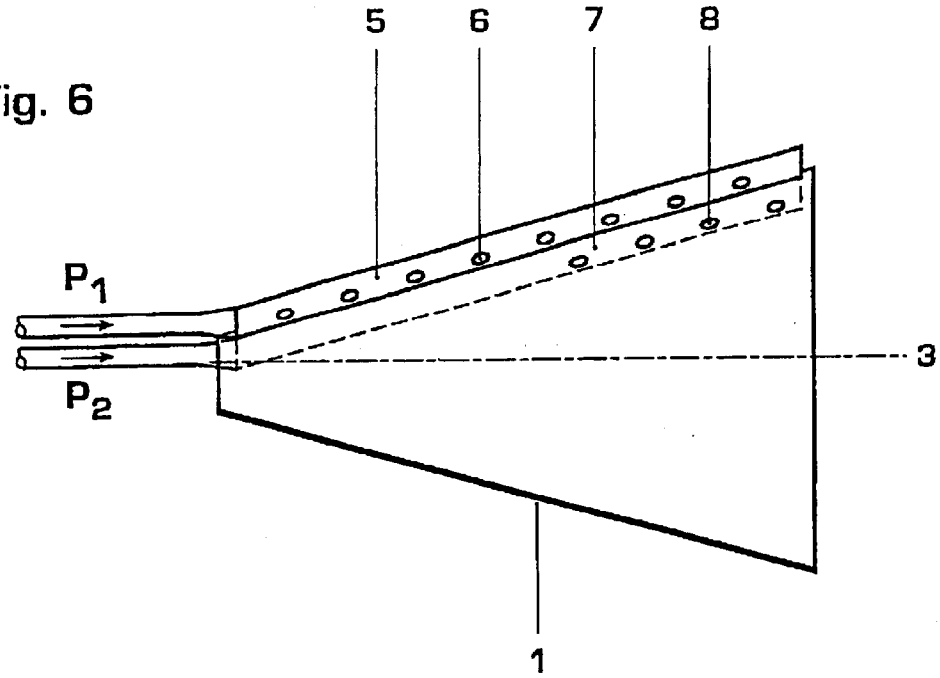
Figure 7:
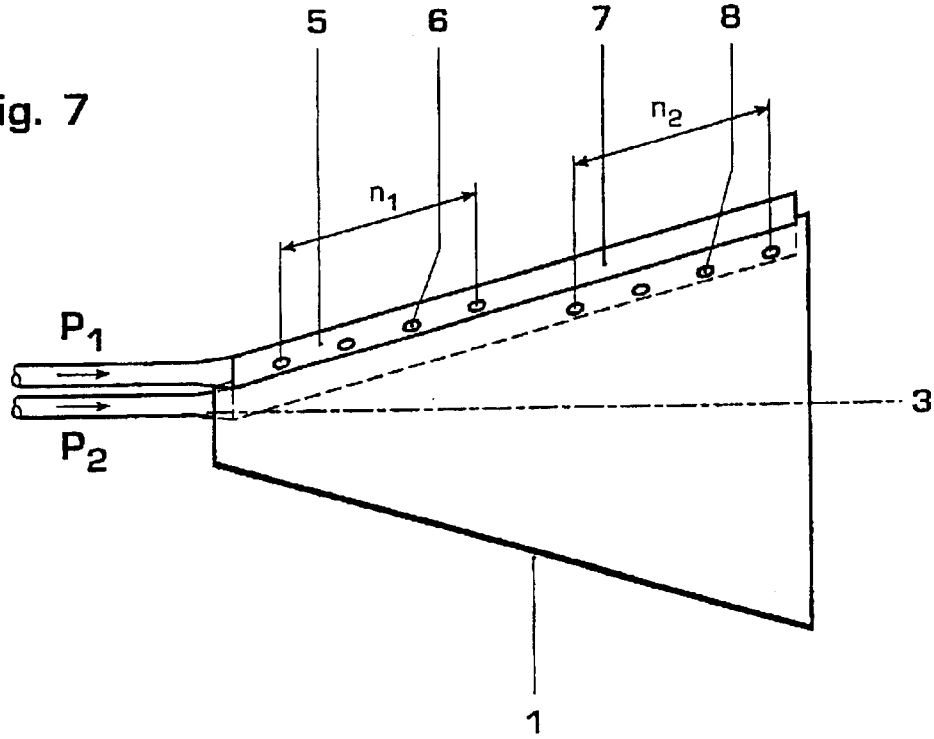

A comparable design with interchanged arrangement of the outlet holes 6, 8 in the direction of the burner longitudinal axis 3 is shown in FIGS. 6 and 7. In the arrangement of FIG. 6, in particular, the enrichment of the outer region of the burner, i.e. the region facing towards the combustion chamber, can be achieved by means of the second stage. Fundamentally, a desired concentration gradient of the fuel along the burner longitudinal axis can be set by means of arrangements such as are represented in FIGS. 4 to 7.

By means of an arrangement such as is represented in FIG. 4, it is also possible to supply pilot fuel at low loads. In this case, starting is carried out with the stage which injects the fuel into the center of the burner. With increasing load, the second stage is then switched on. At full load, for which as uniform as possible fuel distribution is desired, operation is then by means of the second stage only.

Figure 8:
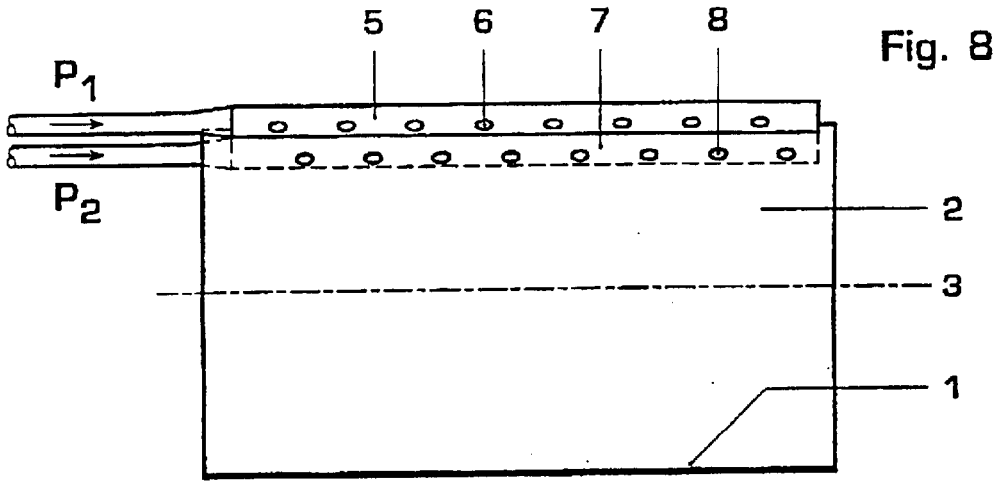
FIG. 8 shows, diagrammatically, an example of a burner with a cylindrical swirl generator which can be operated with the method according to the invention.

FIG. 8 shows a further example of the embodiment of a burner according to the invention, in strongly diagrammatic representation. In this example, a purely cylindrical swirl body 1 is employed. The two supply conduits 5, 7 indicated in the figure, with the first outlet holes 6 and second outlet holes 8, can be designed and arranged in a similar manner, as has already been explained in association with the previous figures.

Figure 9:
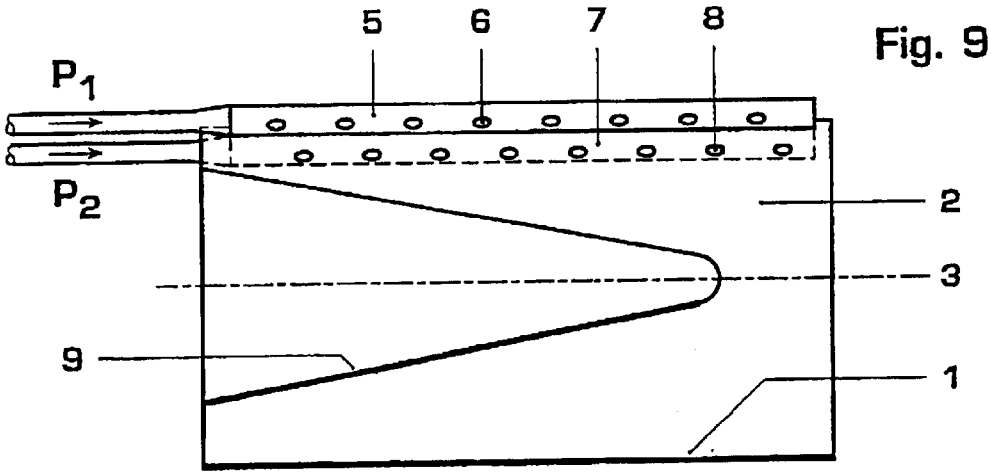
FIG. 9 shows an example of a burner construction with cylindrical swirl body and conical inner body, such as can be operated with the method according to the invention.

A further embodiment of a burner using, in this example, a cylindrical swirl generator 1 with conical inner body 9 for carrying out the present method is represented, as an example, in FIG. 9. In this case, FIG. 9 again shows the first supply duct 5 and the second supply duct 7, with the corresponding outlet openings 6, 8. In the exemplary embodiment of FIG. 9, these supply ducts are arranged adjacent to one another in the outer shell of the swirl body 1.

Figure 10:
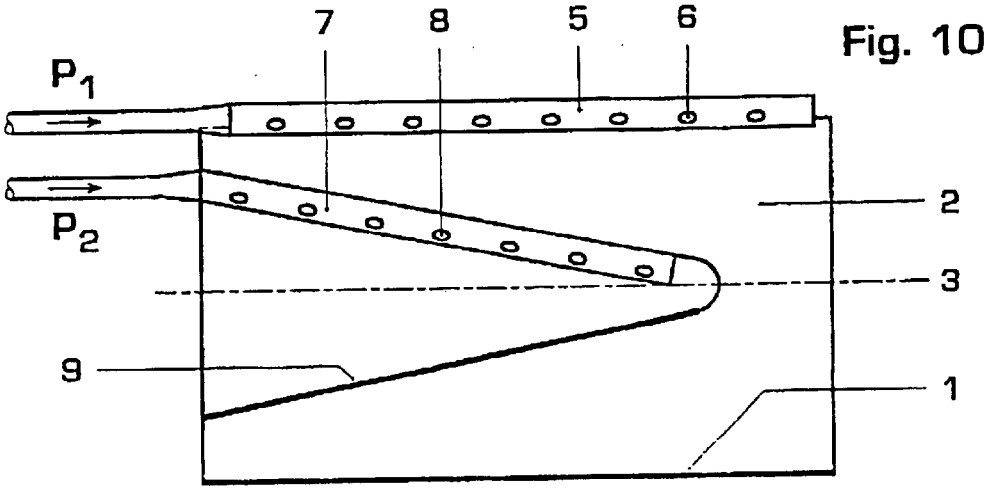
FIG. 10 shows a first example of the design of a burner according to the invention.
Figure 11:
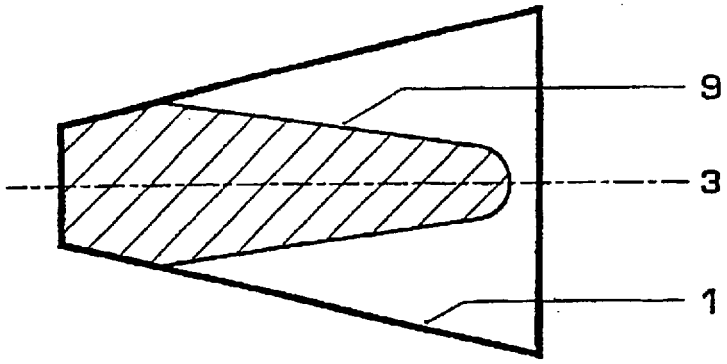
FIGS. 11 to 14 show, diagrammatically, examples of further swirl generator geometries by means of which the present invention can be effected.
Figure 12:
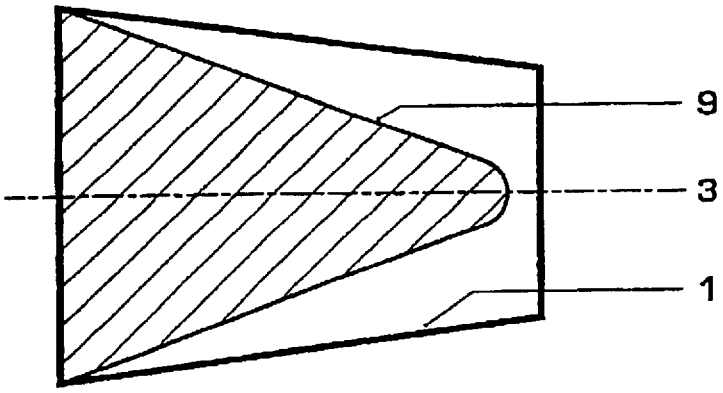
Figure 13:
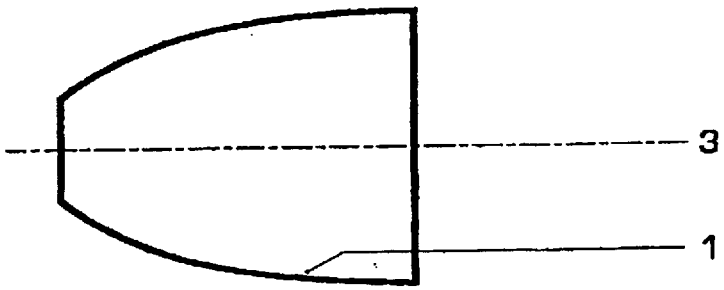
Figure 14:
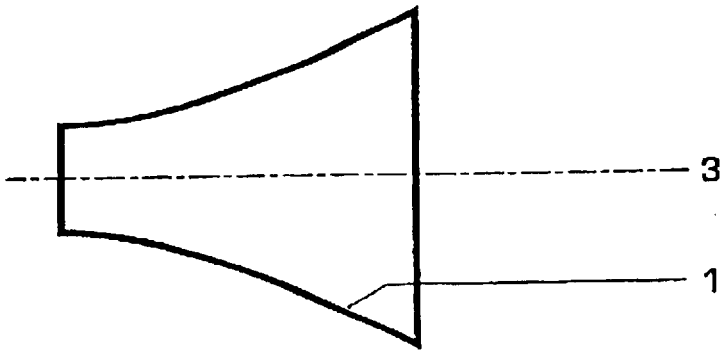

FIG. 10 shows an example of an embodiment of the burner according to the invention in which the second supply duct 7 is arranged on the cylindrical inner body 9.

In this arrangement, the second supply duct 7 is preferably arranged within the outer wall of the inner body 9, a symmetrical distribution of a plurality of supply ducts 7 around the burner longitudinal axis 3 being desirably selected in this case, as in the case of the previous examples. In this example, however, it is also possible to let the second supply conduit 7 extend centrally within the inner body 9, it being then necessary to configure the outlet openings 8 by means of corresponding ducts extending radially relative to the swirl space 2. One or a plurality of additional outlet openings with a correspondingly separated fuel supply (as pilot stage) or air can also be provided in the front, narrowing region of the inner body 9.

The FIGS. 11 to 14 show, diagrammatically, examples of further swirl generator geometries by means of which the present invention can be effected. Represented from top to bottom in the figures are a burner with conical swirl body 1 and conical inner body 9, a burner with swirl body 1 configured in the form of a reversed cone and conical inner body 9, a burner with tulip-shaped swirl body 1 and a burner with funnel-shaped swirl body 1. In all these burner geometries, the second supply conduits can be arranged both in the swirl body 1 and in the inner body 9, as in the previous examples. A common feature of all the geometries shown here is the fact that the axial flow cross section of the swirl space increases toward the burner outlet in the region of the swirl body. Although this is not an absolutely necessary precondition for a premix burner of the generic type, it is an advantageous embodiment of the swirl generator.

Figure 15:
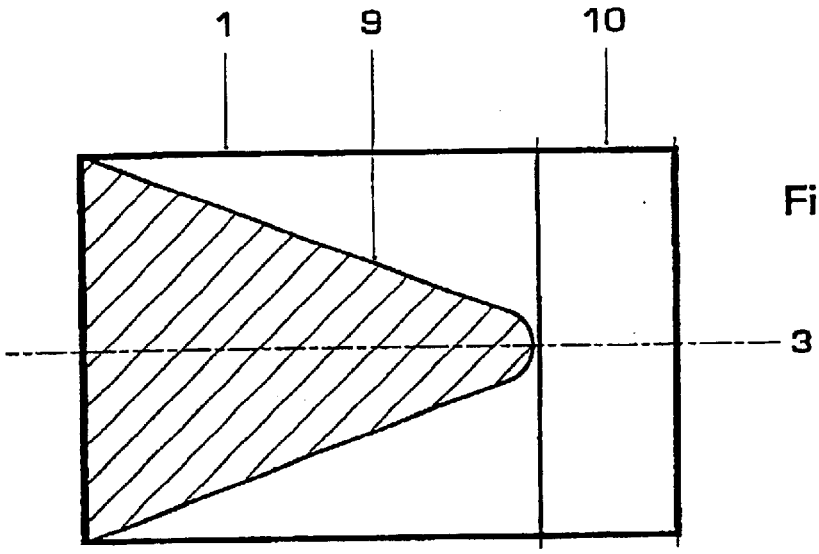
FIGS. 15 and 16 show swirl generator geometries with a downstream premixing tube, by means of which the invention can be effected.
Figure 16:
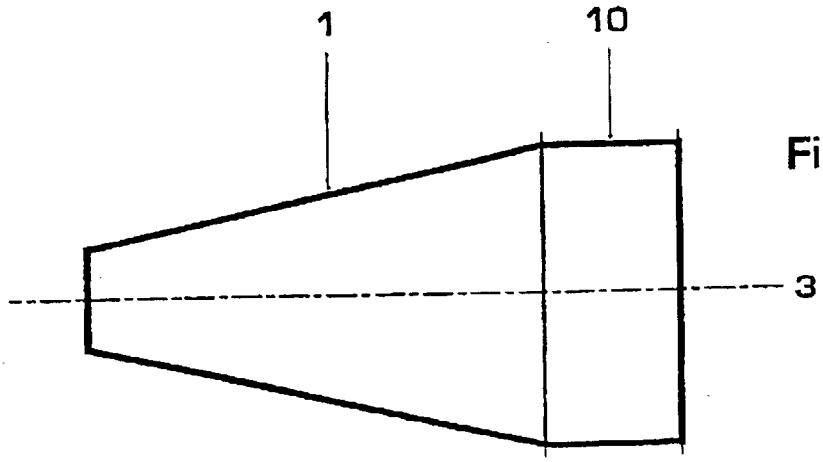

In addition, all the burner geometries can be provided with a premixing tube 10, as is illustrated as an example in FIG. 15 for a conical burner and in FIG. 16 for a cylindrical burner with conical inner body 9.

Figure 17:
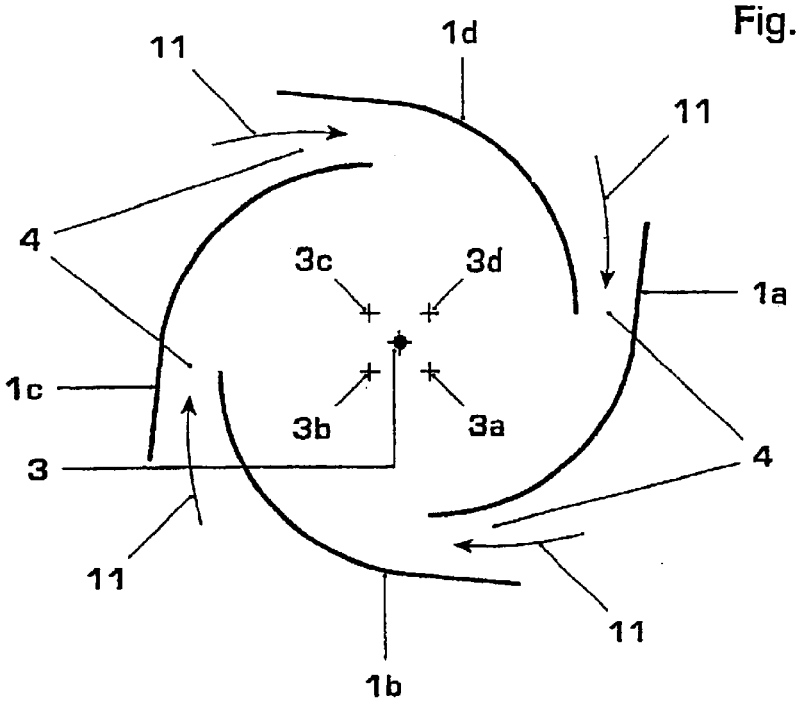
FIGS. 17 and 18 show, diagrammatically, examples of the construction of the swirl body in cross section, such as can be employed in the burner according to the invention.
Figure 18:
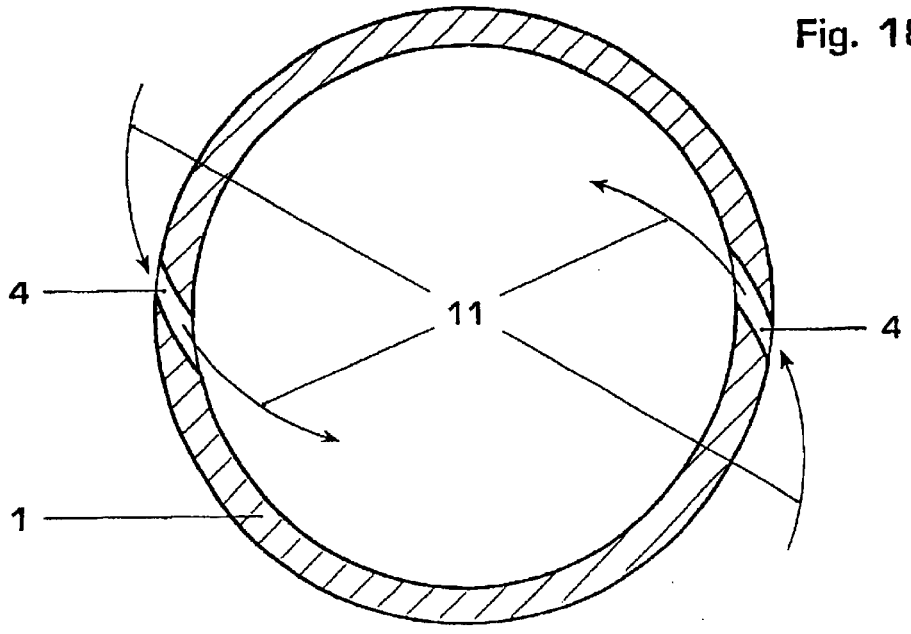

Finally, FIGS. 17 and 18 show, diagrammatically, two examples for the construction of a swirl body, in cross section, such as can be employed in the burner according to the invention. FIG. 17 represents a swirl body which is composed of four mutually offset shells 1*a*, 1*b*, 1*c*, 1*d* which, in the arrangement represented, form four tangential air inlet slots 4. In the cross section shown, the shells can be formed differently, for example as circular-shaped segments, elliptical or oval. In the configuration represented, the partial bodies 1*a*, 1*b*, 1*c*, 1*d* are arranged in such a way that their respective central axes 3*a*, 3*b*, 3*c*, 3*d* are arranged offset relative to the actual burner longitudinal axis. The design of a burner, with or without mixing tube, with such a geometry can be taken in detail from EP 321 809 or EP 0780629.

FIG. 18 represents a monolithic swirl body 1 with tangential air inlet openings 4 introduced into it. The air inlet openings 4 can, for example, be configured as air inlet slots, which have been milled on, or as rows of air inlet holes.

The combinations of the supply ducts and the arrangement or design of the outlet openings in the supply ducts, as given in the previous and following examples, can be arbitrarily altered or combined with one another. As an example, all the variants of the outlet opening arrangements represented in FIGS. 4 to 7 can also be used in the designs of FIGS. 8 to 16. This applies both to the distribution and number and to the arrangement of the individual outlet openings. Furthermore, different hole diameters can be employed in the two supply ducts in the case of all the variants shown. In this way, a certain upstream pressure and a desired outlet velocity can be set in the stage which has to accept a smaller fuel quantity. In this case, no limits are set to the combination possibilities of the individual design variants. The specialist will select the corresponding arrangement to suit the desired deployment condition and desired effects. In particular, it is by no means imperative to arrange the outlet openings equidistantly in the axial direction, as is implicit in all the drawings. Quite on the contrary, it can be found to be highly advantageous to arrange the outlet openings for the premix fuel in an arbitrary axial distribution, or to implement other distribution rules, such as a geometrical staging of the axial distances apart.

The same applies to the employment of different burner geometries or the combination of swirl generators with inner bodies or premixing tubes. The specialist can see that it is possible to effect the present invention with different burner types and combinations of swirl bodies, inner bodies, premix tubes and other known features of burners.

Figure 19:
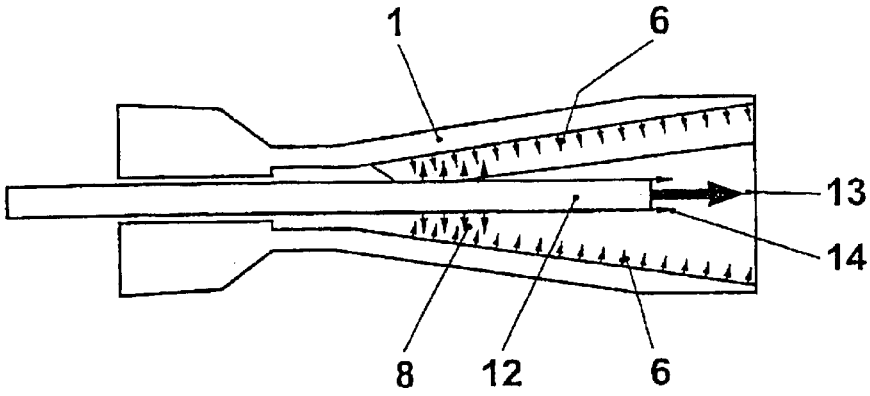
FIGS. 19 to 21 show further examples of the design of a burner according to the invention.
Figure 20:
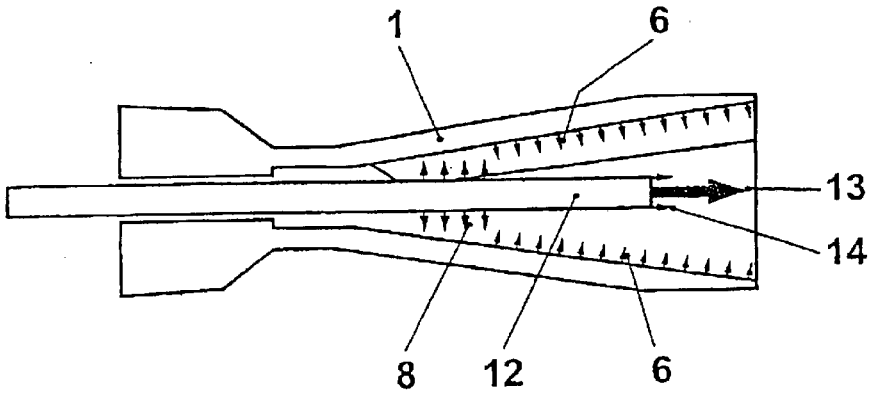
Figure 21:
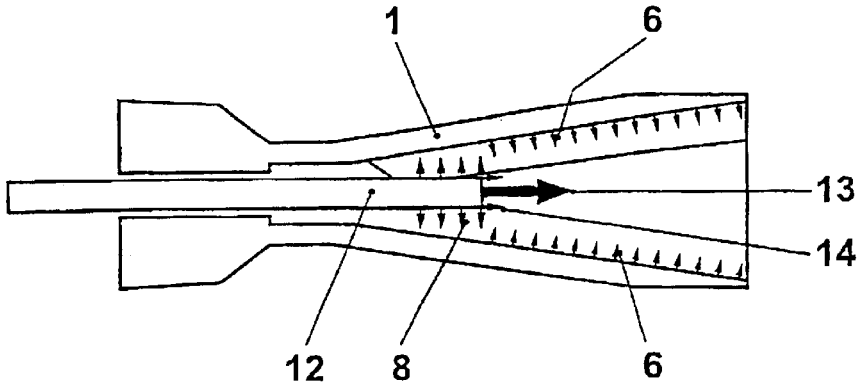

Further very advantageous embodiments of a burner may be recognized in FIGS. 19 to 21. The burners represented comprise the conical swirl body 1, in whose outer shell are arranged, on the inlet flow edges of the air inlet slots, a first group of outlet openings 6 for premix gas. The burners are, furthermore, equipped with a central fuel lance 12, which can have a nozzle at their combustion-chamber ends, i.e. at their tip—as in the present example which nozzle can be used for a liquid fuel 13 or for a pilot fuel. Outlet openings for shroud air 14 can be provided, in a known manner, around this nozzle. In addition to the fuel supply conduits to the first group of outlet openings 6 and a fuel supply conduit for injecting liquid fuel 13 at the tip of the fuel lance 12, the burners represented have a further fuel supply conduit to a second group of outlet openings 8 in the fuel lance 12. The outlet openings 8 of the second group are essentially arranged in the outer surface of the fuel lance 12 in the direction of the burner longitudinal axis, as may be seen in FIGS. 19 to 21, and are preferably distributed radially symmetrically about the longitudinal axis of the fuel lance 12. They permit the injection of fuel from the fuel lance 12 into the swirl space in such a way that it is directed radially outward. The number and size of these outlet openings 8 and their distribution on the fuel lance 12—in the axial direction and peripheral direction are selected as a function of the respective requirements of the burner, such as extinguishing limits, pulsations and flash-back limits.

The fuel lance 12 can extend relatively far into the swirl space (see FIGS. 19 and 20; "Long Lance EV Burner") or, also, protrude only a short distance into the swirl space (FIG. 21). In both cases, the second group of outlet openings 8 is preferably arranged on the fuel lance 12 in the rear region of the swirl space, i.e. in the region furthest removed from the combustion chamber, as is indicated in the figures.

In these exemplary embodiments also, it is obviously possible to have open-chain or closed-loop control of the fuel supply to the first group of outlet openings 6 independently of the fuel supply to the second group of outlet openings 8.

The embodiment of FIG. 19 permits a very advantageous, staged mode of operation of the burner, in which mode both the fuel supply conduits to the first group of outlet openings 6 and the fuel supply conduits to the second group of outlet openings 8 are fed with premix gas. The possibility of independently controlling the fuel supply to the first and second groups of outlet openings 6, 8 permits a mode of operation which is optimally matched to the respective operating conditions of the burner or of the installation utilizing the burner. In this example, the second group of outlet openings 8 on the fuel lance 12 are located opposite to the outlet openings of the first group of outlet openings 6 on the swirl body 1 so that, under certain operating conditions, it is also possible to exclusively supply the first and second groups of outlet openings 6, 8 with fuel, i.e. without supplying the other respective group.

In principle, given corresponding supply of the fuel and corresponding design of the second group of outlet openings, the burner represented in the figure can also be operated in the diffusion mode by means of these outlet openings 8. Because of the spatial separation of the outlet openings 8 from the injection of liquid fuel 13 at the tip of the fuel lance 12, it is possible, in this case and in contrast to known burners, to avoid the penetration of fuel droplets or of fuel vapor into the fuel supply system for the second group of outlet openings 8.

FIG. 20 shows an embodiment of a burner which can likewise be operated in the very advantageous staged mode of operation. The outlet openings 6 are closed or no outlet openings 6 are provided on the regions of the swirl body 1 opposite to the second group of outlet openings 8 because the function of these openings is taken over by the outlet openings 8 on the fuel lance 12. FIG. 21 shows the same burner with shortened fuel lance 12, which burner is configured for the same mode of operation.

Figure 22:
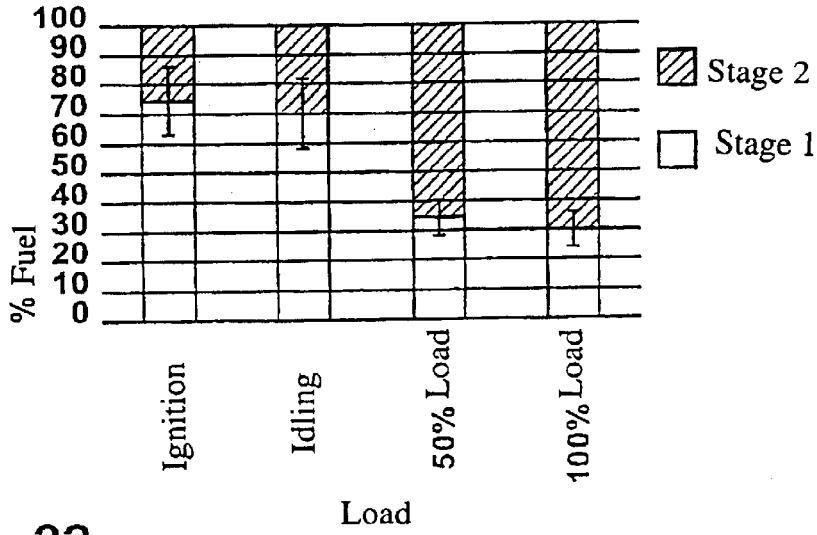
FIG. 22 shows an example of the mode of operation of a burner from FIGS. 20 and 21.

During the operation of these burners, premix gas is admitted to both groups of outlet openings 6, 8. Ignition and starting of the burner takes place in a mode of operation in which the premix gas is mainly introduced into the swirl space via the outlet openings 8 on the fuel lance 12, also designated as stage 1 below. With increasing load, the supply of the premix gas to Stage 1 is reduced and the supply of premix gas via the first group of outlet openings 6, designated as stage 2 below, is increased. Such a distribution of the premix fuel between the stages 1 and 2 as a function of the operating condition of the burner can be taken, as an example, from FIG. 22.

In this way, a gas turbine can, for example, be operated with such a burner from ignition to basic load without a pilot stage.

The supply of fuel to the stages 1 and 2 is controlled, in an open-chain or closed-loop manner, by means of suitable valves.

Figure 23:
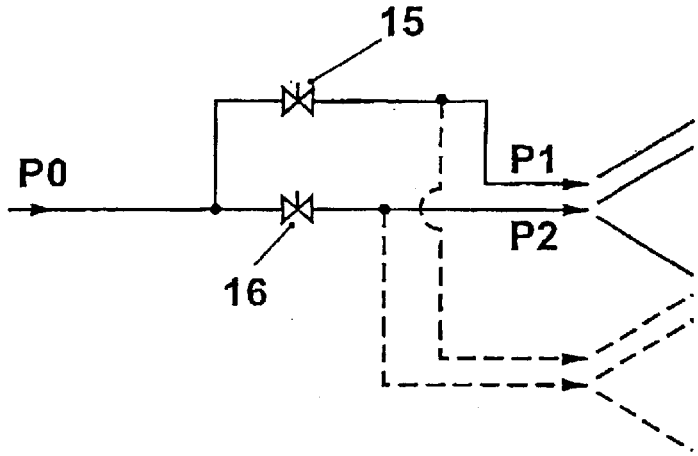
FIGS. 23 and 24 show, diagrammatically, two examples of the design of the fuel supply conduits for carrying out the method according to the invention.
Figure 24:
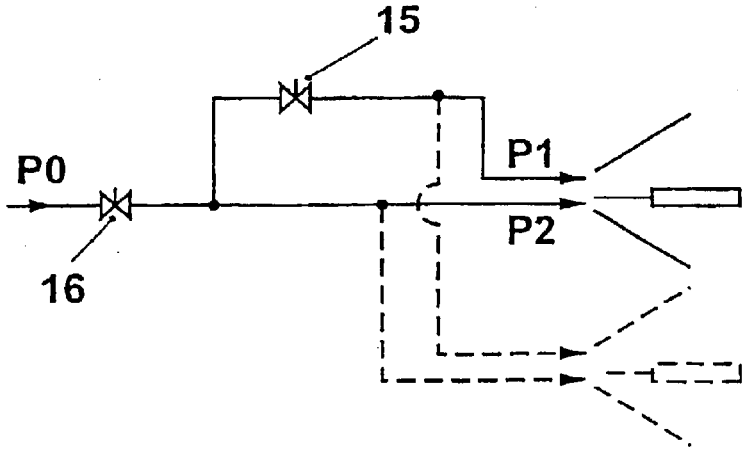

FIGS. 23 and 24 show examples of the supply of a fuel quantity P0 to the burner. In the case of both examples, the fuel line branches in order to divide the total fuel quantity P0 between a fuel quantity P1 for the first group of outlet openings 6 and a fuel quantity P2 for the second group of outlet openings 8.

In FIG. 23, the setting of the division ratio or mass flow ratio takes place by means of one valve 15 or 16 in each of the branches. FIG. 24 shows an embodiment in which the one valve 16 is arranged before the branch for setting the total fuel quantity P0 and a further valve 15 is arranged in the branch for the first group of outlet openings 6. By controlling the valve 15, it is possible to change the mass flow ratio between P1 and P2 in this case also. In this example, the valve 15 can, of course, also be arranged in the branch to the second group of outlet openings 8.

In addition, such an arrangement also permits a plurality of burners to be simultaneously supplied with fuel at the mass flow ratio set, as is indicated by the dashed lines in the figures.

In both exemplary embodiments, the mass flow ratio P1/P2 is changed by activating the valves as a function of the operating condition of the burner. The change to the mass flow ratio can be controlled, in an open-chain or closed-loop manner, as a function of different measured and operating values, as has already been stated in a previous part of the present description. The designs presented are independent of the burner geometry and can be employed in all burners of the previous exemplary embodiments.

List of Designations

1 Swirl generator
1*a* Swirl generator partial body
1*b* Swirl generator partial body
1*c* Swirl generator partial body
1*d* d Swirl generator partial body
2 Swirl space
3 Burner longitudinal axis
3*a* Longitudinal axis of a swirl generator partial body
3*b* Longitudinal axis of a swirl generator partial body
3*c* Longitudinal axis of a swirl generator partial body
3*d* Longitudinal axis of a swirl generator partial body
4 Inlet openings/air slots
5 First fuel supply conduits
6 First fuel outlet openings
7 Second fuel supply conduits
8 Second fuel outlet openings
9 Inner body
10 Premix tube
11 Combustion air
12 Fuel lance
13 Liquid fuel
14 Shroud air
15 Control valve
16 Control valve
P0 Total fuel quantity
P1 First premix fuel
P2 Second premix fuel
n1 First number of holes
n2 Second number of holes

What is claimed is:

1. A method of operating a burner, said burner having a longitudinal axis, at least one first fuel supply conduit with a first group of fuel outlet openings essentially arranged in the direction of a burner longitudinal axis, the first group for the introduction of a first premix fuel quantity into a swirl space, and at least one second fuel supply conduit with a second group of fuel outlet openings essentially arranged in the direction of the burner longitudinal axis, the at least one second fuel supply conduit being configured and arranged to permit admission of fuel to the at least one second fuel supply conduits independently of the first fuel supply conduit, the method comprising:

controlling the supply of the fuel via the at least one first fuel supply conduit separately from the supply of the fuel via the at least one second fuel supply conduit, said controlling comprising open-chain controlling or closed-loop controlling; and supplying the same fuel to the at least one first and at least one second fuel supply conduits.

2. A method according to claim 1, comprising:

supplying premix fuel to the at least one first fuel supply conduit and to the at least one second fuel supply conduit.

3. A method according to claim 1, comprising:

supplying gaseous fuel to the at least one first fuel supply conduit and to the at least one second fuel supply.

4. A method according to claim 1, comprising:

introducing the fuel into the burner so that it is distributed between the at least one first and the at least one second fuel supply conduits as a function of the load.

5. A method according to claim 1, comprising:

introducing the fuel into the burner so that it is distributed between the at least one first and the at least one second fuel supply conduits as a function of the burner air/fuel ratio.

6. A method according to claim 1, comprising:

in a first operating condition, supplying the total fuel quantity via the at least one first fuel supply conduit, and introducing the total fuel quantity into the combustion airflow via the first group of fuel outlet openings; and in a further operating condition, supplying at least a part of the total fuel quantity to the burner via at least one of the at least one second fuel supply conduits through the second group of fuel supply openings.

7. A method of operating a burner according to claim 1, wherein the burner is in a heat generator, the method comprising:

in a partial load condition of the heat generator, supplying the total fuel via the at least one first fuel supply conduit; and in at least the full-load operation of the heat generator, splitting the fuel between the at least one first fuel supply conduit and the at least one second fuel supply conduit.

8. A burner comprising:

a swirl generator for a combustion airflow;

a swirl space;

means for introducing fuel into the combustion airflow;

wherein the swirl generator includes combustion air inlet openings for the combustion airflow, the combustion air inlet openings entering tangentially into the swirl space;

wherein said means for introducing fuel into the combustion airflow comprises at least one first fuel supply conduit having a first group of fuel outlet openings arranged in the direction of a burner longitudinal axis, the at least one first fuel supply conduit for introducing a first premix fuel quantity (P1);

at least one second fuel supply conduit having a second group of fuel outlet openings arranged in the direction of the burner longitudinal axis, the at least one second fuel supply conduit for introducing a second fuel quantity (P2), said at least one second fuel supply conduit being configured and arranged to permit admission of fuel to said at least one second fuel supply conduit independently of the at least one first fuel supply conduit;

an inner body arranged in the swirl space; and wherein the fuel outlet openings of at least one of said at least one second fuel supply conduit being arranged on the inner body that said fuel outlet openings are essentially distributed in the direction of the burner longitudinal axis.

9. A burner according to claim 8, wherein the inner body comprises a fuel lance having a combustion-space end including at least one outlet nozzle for liquid fuel, pilot fuel, or both.

10. A burner according to claim 8, wherein the second group of fuel outlet openings are arranged in a partial axial region of the inner body remote from the combustion-space end.

11. A burner according to claim 8, wherein the second group of fuel outlet openings is configured and arranged for the supply of premix fuel.

12. A burner according to claim 8, wherein at least one of the first and second groups of fuel outlet openings is arranged in the region of at least one of the air inlet openings.

13. A burner according to claim 8, wherein said at least one first fuel supply conduit comprises a plurality of first fuel supply conduits, and said at least one second fuel supply conduit comprises a plurality of second fuel supply conduits, one of said plurality of second fuel supply conduits being associated with each of the plurality of first fuel supply conduits.

14. A burner according to claims 8, wherein second fuel supply conduits are arranged immediately adjacent to first fuel supply conduits.

15. A burner according to claim 8, wherein the combustion air inlet openings comprise tangential inlet slots extending essentially in the direction of the burner longitudinal axis.

16. A burner according to claim 15, wherein one of said at least one first fuel supply conduit having a group of fuel outlet openings is arranged along each combustion air inlet slot.

17. A burner according to claim 15, wherein one of said at least one second fuel supply conduit having a group of fuel outlet openings is arranged along each inlet slot.

18. A burner according to claim 8, wherein the fuel outlet openings of the at least one second fuel supply conduit are arranged at axial positions between fuel outlet openings of the at least one first fuel supply conduit.

19. A burner according to claim 8, wherein the first and second groups of fuel outlet openings are distributed over the whole of the axial extent of the combustion air inlet openings.

20. A burner according to claim 8, wherein the fuel outlet openings of at least one of the first and second groups are distributed over the whole of the axial extent of the combustion air inlet openings, and the fuel outlet openings of the other of the first and second groups are distributed over a partial axial region of the combustion air inlet openings.

21. A burner according to claim 8, wherein the fuel outlet openings of at least one of the first and second groups are distributed over a first partial axial region of the combustion air inlet openings, and the fuel outlet openings of the other of the first and second groups are distributed over other partial axial regions of the combustion air inlet openings.

22. A burner according to claim 21, wherein the partial axial regions do not overlap.

23. A burner according to claim 21, wherein at least two of the partial axial regions overlap at least partially.

24. A burner according to claim 8, wherein at least two groups of fuel outlet openings have different flow cross sections.

25. A burner according to claim 8, further comprising:

means for independently controlling the premix fuel supply to the at least one first fuel supply conduit and to the at least one second fuel supply conduit.

26. A burner according to claim 25, wherein the means for independently controlling the premix fuel supply comprises:

a first supply line in fluid communication with the at least one first fuel supply conduit;

a second supply line in fluid communication with the at least one second fuel supply conduit;

a common fuel line which branches into the first supply line and into the second supply line; and a valve configured to set the fuel flow quantity, arranged in one of the first arid second fuel supply lines.

27. A burner according to claim 8, wherein said at least one second fuel supply conduit comprises a plurality of second fuel supply conduits configured and arranged so that fuel can be admitted to the plurality of second fuel supply conduits independently of one another.

* * * * *